United States Patent [19]

Simon et al.

[11] Patent Number: 4,689,272

[45] Date of Patent: Aug. 25, 1987

[54] PROCESS FOR A TWO-STAGE HYDROPHILIZING POST-TREATMENT OF ALUMINUM OXIDE LAYERS WITH AQUEOUS SOLUTIONS AND USE THEREOF IN THE MANUFACTURE OF SUPPORTS FOR OFFSET PRINTING PLATES

[75] Inventors: Ulrich Simon, Mainz; Reiner Beutel, Weisbaden; Gerhard Sprintschnik, Taunusstein, all of Fed. Rep. of Germany

[73] Assignee: Hoechst Aktiengesellschaft, Frankfurt am Main, Fed. Rep. of Germany

[21] Appl. No.: 702,257

[22] Filed: Feb. 15, 1985

[30] Foreign Application Priority Data

Feb. 21, 1984 [DE] Fed. Rep. of Germany ..... 3406101

[51] Int. Cl.[4] ..... C25D 11/24; B41N 1/04; B41N 3/00

[52] U.S. Cl. ..... 428/448; 204/27; 204/33; 204/38.3; 204/38.7; 428/451; 428/469; 430/278; 430/302

[58] Field of Search ..... 204/17, 27, 33, 35.1, 204/37.6, 38.3, 38.7; 428/448, 451, 469; 430/278, 302; 101/459, 463.1

[56] References Cited

U.S. PATENT DOCUMENTS

| | | | |
|---|---|---|---|
| 2,714,066 | 7/1955 | Jewett | 95/8 |
| 2,882,153 | 1/1959 | Cohn | 96/75 |
| 2,882,154 | 1/1959 | Cohn | 96/75 |
| 3,181,461 | 5/1965 | Fromson | 101/149.2 |
| 3,276,868 | 10/1966 | Uhlig | 96/1.5 |
| 3,280,734 | 10/1966 | Fromson | 101/149.2 |
| 3,824,159 | 1/1974 | Wehrmann | 204/58 |
| 3,902,976 | 9/1975 | Walls | 204/38 |
| 4,153,461 | 5/1979 | Berghauser et al. | 96/75 |
| 4,376,814 | 3/1983 | Walls | 430/272 |
| 4,399,021 | 8/1983 | Gillich et al. | 204/38 |
| 4,427,765 | 7/1984 | Mohr et al. | 430/525 |
| 4,492,616 | 1/1985 | Pliefke et al. | 204/33 |
| 4,578,342 | 3/1986 | Sekiya | 430/159 |

FOREIGN PATENT DOCUMENTS

| | | |
|---|---|---|
| 0095581 | 12/1983 | European Pat. Off. . |
| 3126627 | 1/1983 | Fed. Rep. of Germany . |
| 8214357 | 4/1983 | South Africa . |
| 1523030 | 8/1978 | United Kingdom . |

*Primary Examiner*—John F. Niebling
*Assistant Examiner*—William T. Leader
*Attorney, Agent, or Firm*—Schwartz, Jeffery, Schwaab, Mack, Blumenthal & Evans

[57] ABSTRACT

The process for manufacturing materials, in the form of sheets, foils or webs, comprised of chemically, mechanically and/or electrochemically roughened and anodically oxidized aluminum or an aluminum alloy, which process is performed with two hydrophilizing post-treatment steps. In post-treatment step (a) a supported aluminum oxide layer is treated with an aqueous alkali metal silicate solution which optionally contains alkaline earth metal ions, and in step (b) the aluminum oxide layer is separately treated with an aqueous solution containing at least one organic polymer comprised of vinylphosphonic acid and/or vinylmethylphosphinic acid monomers, such as polyvinylphosphonic acid. Treatment of the aluminum oxide layer is accomplished by means of immersion and/or electrochemically. Materials prepared by this process are particularly useful as supports for offset printing plates, showing an improved resistance to alkali and a reduced tendency to adsorb dyestuff.

16 Claims, No Drawings

PROCESS FOR A TWO-STAGE HYDROPHILIZING POST-TREATMENT OF ALUMINUM OXIDE LAYERS WITH AQUEOUS SOLUTIONS AND USE THEREOF IN THE MANUFACTURE OF SUPPORTS FOR OFFSET PRINTING PLATES

BACKGROUND OF THE INVENTION

The present invention relates to a process for post-treating roughened and anodically oxidized aluminum, in particular support materials for offset printing plates, with aqueous solutions.

Support materials for offset printing plates are provided, on one or both sides, with a radiation(photo-) sensitive layer (reproduction layer), either by the user directly or by the manufacturers of precoated printing plates. This layer permits the production of a printing image of an original by photomechanical means. After a printing form is thus produced from the printing plate, the image areas carried by the layer support accept ink in the subsequent printing process and, simultaneously, the areas which are free from an image (non-image areas) provide a hydrophilic image background for the lithographic printing operation.

For the above reasons, the following requirements are demanded of a layer support for reproduction layers used in the manufacture of offset printing plates:

- Those portions of the radiation-sensitive layer which have become comparatively more soluble following exposure must be easily removable from the support by a developing operation, in order to produce the hydrophilic non-image areas without leaving a residue.
- The support, which has been laid bare in the non-image areas, must possess a high affinity for water, i.e., it must be strongly hydrophilic, in order to accept water rapidly and permanently during the lithographic printing operation, and to exert an adequate repelling effect with respect to the greasy printing ink.
- The radiation-sensitive layer must exhibit an adequate degree of adhesion prior to exposure, and those portions of the layer which print must exhibit adequate adhesion following exposure.

The preferred base material employed for layer supports of the above-described type is aluminum. More specifically, the aluminum is superficially roughened by means of known methods, such as dry brushing, wet brushing, sandblasting, chemical and/or electrochemical treatment. The roughened substrate then is optionally subjected to an anodizing treatment, during which a thin oxide layer is built up, in order to improve the abrasion resistance.

In practice, the support materials, particularly anodically oxidized support materials based on aluminum, are often subjected to a further treatment step before applying a radiation-sensitive layer, in order to improve the adhesion of the layer, to increase the hydrophilic properties and/or to improve the developability of the radiation-sensitive layer. Such treatments are, for example, carried out according to the following methods:

German Pat. No. 907,147 (corresponding to U.S. Pat. No. 2,714,066), German Auslegeschrift No. 14 71 707 (corresponding to U.S. Pat No. 3,181,461 and U.S. Pat. No. 3,280,734) and German Offenlegungsschrift No. 25 32 769 (corresponding to U.S. Pat No. 3,902,976) describe processes for hydrophilizing support materials for printing plates, which processes utilize aluminum which has optionally been anodically oxidized. In these processes, the materials are treated with an aqueous solution of sodium silicate, with or without the application of an electrical current.

From German Pat. No. 11 34 093 (corresponding to U.S. Pat. No. 3,276,868) and German Pat. No. 16 21 478 (corresponding to U.S. Pat. No. 4,153,461) it is known to use polyvinyl phosphonic acid or copolymers based on vinyl phosphonic acid, acrylic acid and vinyl acetate to hydrophilize support materials for printing plates based on aluminum which has optionally been anodically oxidized.

In accordance with European Patent Application No. 0,048,909 (corresponding to U.S. Pat. No. 4,399,021), it is possible to perform such a post-treating process not only by an immersion treatment, but also by means of electric current. According to the teaching of German Offenlegungsschrift No. 31 27 627 (corresponding to South African Pat. No. 82/4357), a polymer which can also be used in this context is polyvinylmethyl phosphonic acid.

Although these post-treating methods often yield satisfying results, they cannot meet all of the requirements, frequently very complex, demanded of a support material for printing plates to meet the standards now set for high-performance printing plates currently in use.

For example, a certain deterioration of the storability of reproduction layers applied must be accepted after the treatment of supports with alkali metal silicates which produce good developability and good hydrophilic properties. In supports which are treated with water-soluble organic polymers, the good solubility of these polymers, particularly in aqueous alkaline developers of the sort predominantly used for developing positive-working reproduction layers, leads to a decrease in the hydrophilic action. In addition, resistance to alkaline media, which is particularly required when high-performance developers are used in the field of positive-working reproduction layers, is not present to a sufficient degree. Depending on the chemical compositions of the reproduction layers, tinting in the non-image areas is occasionally encountered, which is probably caused by adsorptive effects.

In the prior art, modifications of the silicating processes and also treatment with hydrophilic polymers have already been described. Illustrative examples of these variations include:

- subjecting silicate layers on aluminum printing plate supports, which have been produced by an immersion treatment in aqueous alkali metal silicate solutions, to a hardening post-treatment with an aqueous solution of $Ca(NO_3)_2$ or generally, with a solution of an alkaline-earth metal salt, in accordance with U.S. Pat. No. 2,882,153 and U.S. Pat. No. 2,882,154; as a rule, the alkaline-earth metal salt concentrations exceed 3% by weight. The support materials are roughened by chemical or mechanical means only, and no anodic oxidation takes place.
- German Offenlegungsschrift No. 22 23 850 (corresponding to U.S. Pat. No. 3,824,159) describes a process for coating aluminum moldings, aluminum sheets, aluminum castings or aluminum foils specifically for capacitors, but also for offset printing plates, in which an anodic oxidation is carried out in an aqueous electrolyte composed of an alkali metal silicate and an organic complexforming substance. The latter substance can be selected, for example, from amines, amino acids, sulfonic acids, phenols, glycols and, additionally, from salts of organic carboxylic acids, such as maleic acid, fumaric acid, citric acid and tartaric acid.

The process for producing grain-like or textured surfaces on aluminum, according to German Auslegeschrift No. 26 51 346 (corresponding to British Pat. No. 1,523,030), is carried out directly on the aluminum, using alternating current, in an electrolyte which contains, in an aqueous solution, from 0.01 to 0.5 mol/l of a hydroxide or salt of an alkali metal or alkaline earth metal (e.g., a silicate) and, optionally, from 0.01 to 0.5 mol/l of a substance which forms a barrier layer. The German patent document discloses that the substances forming barrier layers include, among others, citric acid, tartaric acid, succinic acid, lactic acid, malic acid or the salts thereof.

Aluminum support materials for offset printing plates in accordance with German Offenlegungsschrift No. 31 26 636 (corresponding to U.S. Pat. No. 4,427,765), which on an aluminum oxide layer produced by anodic oxidation carry a hydrophilic coating of a complex reaction product of (a) a water-soluble polymer, such as polyvinylphosphonic acid and (b) a salt of an at least bivalent metal cation, such as $Zn^{2+}$, or the process in accordance with European Patent Application 0,089,510 (corresponding to U.S. Pat. No. 4,376,814), for producing aluminum support materials, in particular for offset printing plates, in which the usually anodically oxidized, sheet-like aluminum is post-treated, in a single-state process, with an aqueous solution containing (a) a sodium silicate, for example, and (b) a sodium salt or ammonium salt of a hydrophilic polymer, such as polyvinylphosphonic acid, which displays alkaline reactivity.

The above-summarized modifications of hydrophilizing post-treatments with silicates or certain hydrophilic organic polymers, which can be employed for printing plate supports of aluminum, are incapable of producing surfaces of a quality suitable for high-performance printing plates. In particular, with respect to technological requirements, the layers either have not yet been improved to such an extent that they can fully satisfy the demands set forth above, or the processes for preparing different types of solutions having defined pH values and their control are too complicated and expensive.

German Offenlegungsschrift No. 32 32 485, which was not not pre-published, describes a process for post-treating roughened and anodically oxidized aluminum supports for printing plates, which is performed in two stages using (a) an aqueous alkali metal silicate solution and (b) an aqueous alkaline-earth metal salt solution.

SUMMARY OF THE INVENTION

It is therefore an object of the present invention to provide a process for post-treating an aluminum or aluminum alloy substrate, which process can be used in conjuction with an anodic oxidation of the substrate to produce a surface on the resulting aluminum oxide layer, thereby rendering the substrate able to meet the above-described practical requirements of a high-performance printing plate.

It is another object of the present invention to provide a process for improving the effect on aluminum-based substrate or known hydrophilizing post-treatments which employ silicates or hydrophilic organic polymers, and particularly improving the resistance to alkali of the layers, subjected to such post-treatments.

It is yet another object of the present invention to provide an offset printing plate, displaying superior dyestuff-adsorption and resistance-to-alkali properties.

In accomplishing the foregoing objects, there has been provided, in accordance with one aspect of the present invention, a process for manufacturing a roughened and anodically oxidized aluminum or aluminum alloy substrate, comprising the steps of:

(a) treating an aluminum oxide layer carried on a substrate comprised of aluminum or aluminum alloy in a first aqueous solution containing an alkali metal silicate; and then (b) treating said aluminum oxide layer in a second aqueous solution containing at least one organic polymer comprised of at least one from the group consisting of vinylphosphonic acid monomers and vinyl-methylphosphinic acid monomers.

In one preferred embodiment, the solution used for above-mentioned post-treatment step (a) additionally contains alkaline earth metal ions.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Water-soluble alkaline earth metal salts, preferably calcium and strontium salts, which, in addition to compounds derived from acids, particularly nitrates, also include hydroxides, are generally employed as compounds that yield alkaline earth metal ions. In a preferred embodiment, the aqueous solution used for post-treatment step (a) mentioned above contains (i) 0.5 to 30% by weight, in particular 1 to 15% by weight, of alkali metal silicate (such as sodium metasilicate or the sodium trisilicates and tetrasilicates contained in "water glass") and (ii) optionally 0.001 to 0.5% by weight, in particular 0.005 to 0.3% by weight, of alkaline earth metal ions (such as $Ca^{2+}$ or $Sr^{2+}$). The aqueous solution can additionally contain at least one substance, such as hydroxycarboxylic acids, aminocarboxylic acids nitrogen compounds and phenols containing hydroxy or carboxyl groups (e.g., levulinic acid, ethylene diamine tetraacetic acid or the salts thereof) which are capable of forming complexes with alkaline earth metal ions.

In addition to the homopolymers polyvinyl-methylphosphinic acid and, in particular, polyvinyl-phosphonic acid, the polymers used for post-treatment step (b) also include copolymers of vinylphosphonic acid and/or vinylmethylphosphinic acid, which monomers can be copolymerized with other monomers, such as acrylic acid, acrylamide and vinyl acetate. In a preferred embodiment, the aqueous solution employed for post-treatment step (b) contains 0.01 to 10% by weight, in particular 0.02 to 5% by weight, of at least one of the organic, phosphorus-containing polymers.

One or two of the post-treatment steps can be performed by immersion and/or by electrochemical means. The electrochemical process often results in a further increase in the resistance to alkali and/or in an improvement of the adsorption properties of the material. For the embodiment of the present invention which employs electrochemical processing, direct or alternating current, trapezoidal, rectangular or triangular current, or superimposed forms of these current types are used in the first instance. The current density generally ranges from 0.1 to 10 A/dm$^2$ and/or the voltage ranges from 1 to 100 V. The process parameters also depend, for example, on the distance between the electrodes and the composition of the electrolyte. The material can be post-treated discontinuously or continuously, using modern web processing equipment. It is expedient to select treating times of 0.5 to 120 seconds and treating temperatures of about 15° to 80° C., particularly about 20° to 75° C. It is assumed that a firmly adhering top layer forms in the pores of the aluminum oxide layer, which protects the oxide from attack. With the process of the present invention, the surface topography (such as roughness and oxide pores) produced before the post-treatment is not changed or changed to an insignificant degree only. Therefore, the process according to the present invention is particularly suited for treating materials where it is of great importance to maintain this topography, such as in the case of support materials for printing plates.

By the comparative examples below it is demonstrated that, surprisingly, the post-treatment steps according to the present invention are highly effective only when the process is performed in the claimed order, but not when it is performed in the reverse order.

Suitable base materials for the material to be treated in accordance with this invention include aluminum or one of its alloys having, for example, an Al content of more than 98.5% by weight and, additionally, containing small amounts of Si, Fe, Ti, Cu and Zn. In particular, if support materials for printing plates are to be produced, the sheet-like aluminum is first roughened, optionally after a precleaning step, by mechanical (e.g., brushing and/or treatment with an abrasive agent), chemical (e.g., etching agents) and/or electrochemical (e.g., a.c. treatment in aqueous acid or salt solutions) means. In the process according to the present invention, electrochemical roughening is preferred, but prior to the electrochemical treatment step, the aluminum support materials can be additionally roughened by mechanical means (for example, by brushing with wire or nylon brushes and/or by treatment with an abrasive agent). All process steps can be carried out discontinuously using plates or foils, but preferably they are performed continuously using webs.

Especially in continuous processes, the process parameters characterizing the electrochemical roughening step are normally within the following ranges: temperature of the aqueous electrolyte, which in general contains 0.3 to 5.0% by weight of acid(s) (in the case of salts this content can be higher), of about 20° C. to 60° C.; current density of about 3 to 200 A/dm$^2$; dwell time, for a material spot to be roughened in the electrolyte, of about 3 to 100 seconds; and a rate of electrolyte flow over the surface of the material to be roughened of about 5 to 100 cm/s. In discontinuous processes, the required current densities tend to be in the lower region, and the dwell times rather in the upper region, of the above-indicated ranges, respectively, and a flow of the electrolyte can even be dispensed with in these processes.

The type of current employed is usually ordinary alternating current, having a frequency of 50 to 60 Hz, but it is also possible to use modified current types, such as alternating current having different current intensity amplitudes for the anodic and for the cathodic current, lower frequencies, interruptions of current, or superposition of two currents having different frequencies and wave shapes. The average peakto-valley height ($R_z$) of the roughened surface is in a range from 1 to 15 μm, in particular from 1.5 to 8.0 μm. If the aqueous electrolyte contains acid(s), in particular HCl or $HNO_3$, aluminum ions in the form of aluminum salts, in particular $Al(NO_3)_3$ and/or $AlCl_3$, can also be added; furthermore, it is known to add certain other acids and salts, such as boric acid or borates or to add corrosion-inhibiting substances, such as amines.

Precleaning includes, for example, treatment with an aqueous NaOH solution with or without a degreasing agent and/or complex formers, trichloroethylene, acetone, methanol or other commercially available substances known as aluminum treatment agents. Following roughening or, in the case of several roughening steps, between the individual steps, it is possible to perform an additional abrasive treatment, during which, in particular, a maximum amount of 2 g/m$^2$ is abraded (between the individual steps, up to 5 g/m$^2$). Abrasive solutions in general are aqueous alkali metal hydroxide solutions or aqueous solutions of salts showing alkaline reactivity, or are aqueous solutions of acids based on $HNO_3$, $H_2SO_4$ or $H_3PO_4$, respectively. Apart from an abrasive treatment step performed between the roughening step and a subsequent anodizing step, there are also known non-electrochemical treatments which substantially have a purely rinsing and/or cleaning effect and are, for example, employed to remove deposits which have formed during roughening ("smut"), or simply to remove electrolyte residue; for example, dilute aqueous alkali metal hydroxide solutions or water can be used for these treatments.

The electrochemical roughening process is followed by an anodic oxidation of the aluminum in a further process step, in order to improve, for example, the abrasion and adhesion properties of the surface of the support material. Conventional electrolytes, such as $H_2SO_4$, $H_3PO_4$, $H_2C_2O_4$, amidosulfonic acid, sulfosuccinic acid and sulfosalicylic acid, or mixtures thereof, may be used for the anodic oxidation. Particular preference is given to $H_2SO_4$ and $H_3PO_4$, which may be used alone or in a mixture and/or in a multi-stage anodizing process. Usually, the oxide layer weights range from about 1 to 8 g/m$^2$, corresponding to layer thicknesses between about 0.3 and 2.5 μm.

The materials prepared in accordance with the present invention are preferably used as supports for offset printing plates, i.e., one or both surfaces of the support material are coated with a photosensitive composition, either by the manufacturers of presensitized printing plates or directly by the users. Radiation-sensitive layers basically include all layers which, after irradiation (exposure) and, optionally, development and/or fixing, yield a surface in imagewise configuration which can be used for printing.

Apart from the silver halide-containing layers used for many applications, various other layers are known, as described, for example, in "Light-Sensitive Systems" by Jaromir Kosar, published by John Wiley & Sons, New York, 1965. These include colloid layers containing chromates and dichromates (Kosar, Chapter 2); layers containing unsaturated compounds which, upon exposure, are isomerized, rearranged, cyclized, or crosslinked (Kosar, Chapter 4); layers containing monomer or prepolymer compounds which, on being exposed, undergo polymerization, optionally with the aid of an initiator (Kosar, Chapter 5); and layers containing o-diazoquinones, such as naphtho-quinone diazides, p-diazoquinones, and condensation products of diazonium salts (Kosar, Chapter 7).

The layers which are suitable for the present invention also include electrophotographic layers, i.e., layers which contain an inorganic or organic photoconductor. In addition to photosensitive substances, these layers can, of course, also contain other constituents, such as for example, resins, dyes or plasticizers. In particular, the following photosensitive compositions or compounds can be employed in the coating of the support materials prepared in accordance with the present invention:

Positive-working reproduction layers which contain, as light-sensitive compounds, o-quinone diazides, preferably o-naphthoquinone diazides, such as high or low molecular-weight naphthoquinone-(1,2)-diazide-(2)-sulfonic acid esters or amides, which are described, for example, in German Pat. Nos. 854,890; 865,109; 879,203; 894,959; 938,233; 1,109,521; 1,144,705; 1,118,606; 1,120,273; 1,124,817; and 2,331,377, and in European Patent Application Nos. 0,021,428 and 0,055,814.

Negative-working reproduction layers which contain condensation products from aromatic diazonium salts and compounds with active carbonyl groups, preferably condensation products formed from diphenylaminediazonium salts and formaldehyde, which are described, for example, in German Pat. Nos. 596,731; 1,138,399; 1,138,400; 1,138,401; 1,142,871 and 1,154,123, in U.S. Pat. Nos. 2,679,498 and 3,050,502, and in British Pat. No. 712,606.

Negative-working reproduction layers which contain co-condensation products of aromatic diazonium compounds, such as, for example, those described in German Pat. No. 20 65 732, which comprise products possessing at least one unit each of (a) an aromatic diazonium salt compound that can participate in a condensation reaction and (b) a second compound that can also participate in a condensation reaction, such as a phenol ether or an aromatic thioether, units (a) and (b) being connected by a bivalent linking member derived from a carbonyl compound which is capable of participating in a condensation reaction, such as a methylene group.

Positive-working layers according to German Offenlegungsschrift No. 26 10 842, German Pat. No. 27 18 254 or German Offenlegungsschrift No. 29 28 636, that contain (a) a compound which, on being irradiated, splits off an acid, (b) a monomeric or polymeric compound that possesses at least one C-O-C group which can be split off by acid (e.g., an orthocarboxylic acid ester group or a carboxylic acid amid acetal group), and, if appropriate, (c) a binder.

Negative-working layers, composed of photopolymerizable monomers, photo-initiators, binders and, if appropriate, further additives. In these layers, for example, acrylic and methacrylic acid esters, or reaction products of diisocyanates with partial esters of polyhydric alcohols, are employed as monomers, as described, for example, in U.S. Pat. Nos. 2,760,863 and 3,060,023, and in German Offenlegungsschriften Nos. 20 64 079 and 23 61 041.

Negative-working layers according to German Offenlegungsschrift No. 30 36 077, which contain, as the photo-sensitive compound, a diazonium salt polycondensation product or an organic azido compound, and, as the binder, a high-molecular weight polymer with alkenylsulfonylurethane or cycloalkenylsulfonylurethane side groups.

It is also possible to apply photo-semiconducting layers to the support materials prepared in accordance with this invention, such as described, for example, in German Pat. Nos. 11 17 391, 15 22 497, 15 72 312, 23 22 046, and 23 22 047, as a result of which highly photosensitive electrophotographic printing plates are obtained.

From the coated offset printing plates prepared from the support materials produced in accordance with the present invention, the desired printing forms are obtained in a known manner by imagewise exposure or irradiation, followed by the washing out of non-image areas by means of a developer, preferably an aqueous developer solution.

Surprisingly, offset printing plates, the base materials of which have been post-treated according to the process of the present invention, are distinguished, in comparison with plates comprising the same base material which has been post-treated with aqueous solutions that contain only alkali metal silicates or phosphorus-including organic polymers, by improved hydrophilic properties of the non-image areas, a reduced tendency to tinting, and an improved resistance to alkali.

In the preceding description and in the examples which follow, percentages always denote percentages by weight, unless otherwise indicated. Parts by weight are related to parts by volume as g is related to $cm^3$. Moreover, the following methods were used in the examples for the determination of various parameters:

In order to examine whether the surface exhibits dyestuff adsorption properties, a cut piece of plate material, which had been coated with the radiation-sensitive layer, was exposed and developed, and then one half of it was treated with a deletion fluid. The greater the observed difference in, for example, the color values between the untreated and the treated half, the more dyestuff had been adsorbed on the untreated portion of the surface of the support material. The dyestuff adsorption values ranged from 0 to 5, 0 denoting no dyestuff adsorption, 1 denoting slight dye-stuff adsorption and 5 denoting strong dyestuff adsorption. (Only half steps are indicated below.)

The resistance to alkali of the surface was determined by immersion of a cut piece of plate material, which had not been coated with a radiation-sensitive layer, in a dilute aqueous solution of NaOH, for a predetermined period (for example, 30 minutes), with subsequent visual assessment of the oxide layer. Values a to e below designate the alkali resistance, a denoting no oxide layer attack, e denoting severe oxide layer attack. (Only full values are given.)

Suitable radiation-sensitive layers, which were applied to the support material, were either a negative-working layer containing (i) a reaction product of polyvinyl butyral and propenylsulfonylisocyanate, (ii) a polycondensation product obtained from 1 mol of 3-methoxy-diphenylamine-4-diazonium sulfate and 1 mol of 4,4'-bismethoxymethyl diphenyl ether, precipitated as the mesitylene sulfonate, (iii) $H_3PO_4$, (iv) Viktoria Pure Blue FGA and (v) phenylazo-diphenylamine; or a positive-working layer containing (a) a cresol/formaldehyde novolak, (b) 4-(2-phenylprop-2-yl)-phenyl ester of naphthoquinone-(1,2)-diazide-(2)-sulfonic acid-(4), (c) polyvinyl butyral, (d) naphthoquinone-(1,2)-diazide-(2)-sulfonic acid chloride-(4) and (e) crystal violet. Printing plates and printing forms which are suited for practical use were produced in this way.

COMPARATIVE EXAMPLE C 1

In an aqueous solution containing 1.4% of $HNO_3$ and 6% of $Al(NO_3)_3$, an aluminum web was electrochemically roughened, using alternating current (115 A/dm$^2$ at 35° C.), and was then anodically oxidized in an aqueous solution containing $H_2SO_4$ and $Al^{3+}$ ions, using direct current. The resulting oxide layer, without post-treatment, was assigned to grade 3 with respect of dyestuff adsorption and grade a with respect of resistance to alkali.

COMPARATIVE EXAMPLE C 2

The procedure employed was the same as described in Comparative Example C1, with the exception that roughening was performed in an aqueous solution containing 0.9% of HCl. The level of dyestuff adsorption was grade 5, while the level of resistance to alkali was grade a.

COMPARATIVE EXAMPLE C 3

The procedure employed was the same as described in Comparative Example C1, with the exception that samples of the web were post-treated by immersion in an aqueous solution containing 4% of $Na_2SiO_3$ for 30 seconds at a temperature of 40° C. The post-treated oxide layer was assigned to grade 3.5 with respect to dyestuff adsorption and to grade a with respect to resistance to alkali.

COMPARATIVE EXAMPLE C 4

The procedure employed was the same as described in Comparative Example C2, with the exception that samples of the web were post-treated by immersion in an aqueous solution containing 4% of $Na_2SiO_3$ for 30 seconds at a temperature of 40° C. The post-treated oxide layer was assigned to grade 3 with respect to dyestuff adsorption and to grade a with respect to resistance to alkali.

COMPARATIVE EXAMPLE C 5

The procedure employed was the same as described in Comparative Example C1, with the exception that samples of the web were electrochemically (40 V direct current) post-treated in an aqueous solution containing 4% of $Na_2SiO_3$, for 30 seconds at a temperature of 25° C. The post-treated oxide layer was assigned to grade 1 in respect to dyestuff adsoprtion and to grade a with respect to resistance to alkali.

COMPARATIVE EXAMPLE C 6

The procedure employed was the same as described in Comparative Example C2, with the exception that samples of the web were electrochemically (40 V direct current) post-treated for 30 seconds at a temperature of 25° C., in a aqueous solution containing 4% of $Na_2SiO_3$. The post-treated oxide layer was assigned to grade 1.5 with respect to dyestuff adsorption and to grade a with respect to resistance to alkali.

COMPARATIVE EXAMPLE C 7

The procedure employed was the same as described in Comparative Example C1, but with the exception that samples of the web were post-treated by immersion in an aqueous solution containing 0.5% of polyvinylphosphonic acid, for 30 seconds and at a temperature of 60° C. The post-treated oxide layer was assigned to grade 1.5 with respect to dyestuff adsorption and to grade d with respect to resistance to alkali.

COMPARATIVE EXAMPLE C 8

The procedure employed was the same as described in Comparative Example C2, but with the exception that samples of the web were post-treated by immersion in an aqueous solution containing 0.5% of weight of polyvinylphosphonic acid, for 30 seconds and at a temperature of 60° C. The post-treated oxide layer was assigned to grade 2 with respect to dyestuff adsorption and to grade e with respect to resistance to alkali.

COMPARATIVE EXAMPLE C 9

The procedure employed was the same as described in Comparative Example C1, but with the exception that samples of the web were post-treated electrochemically (50 V direct current) in an aqueous solution containing 0.5% of phosphonic acid, for 30 seconds and at a temperature of 25° C. The post-treated oxide layer was assigned to grade 1 with respect to dyestuff adsorption and to grade a with respect to resistance to alkali.

COMPARATIVE EXAMPLE C 10

The procedure employed was the same as described in Comparative Example C2, but with the exception that samples of the web were post-treated electrochemically (50 V direct current) in an aqueous solution containing 0.5% of polyvinylphosphonic acid, for 30 seconds and at a temperature of 25° C. The post-treated oxide layer was given grade 1 with respect to dyestuff adsorption and to grade d with respect to resistance to alkali.

EXAMPLE 1

Post-treatment was first performed as described in Comparative Example C3 and then as described in Comparative Example C7. The oxide layer thus post-treated in two steps was assigned to grade 0.5 with respect to dyestuff adsorption and to grade b with respect to resistance to alkali.

EXAMPLE 2

Post-treatment was first performed as described in Comparative Example C4 and then as described in Comparative Example C8. The oxide layer thus post-treated in two steps was assigned to grade 0.5 with respect to dyestuff adsorption and to grade b with respect to resistance to alkali.

COMPARATIVE EXAMPLE C 11

Post-treatment was first performed as described in Comparative Example C7 and then as described in Comparative Example C3. The oxide layer thus post-treated in two steps was assigned to grade 1.5 with respect to dyestuff adsorption and to grade b with respect to resistance to alkali.

COMPARATIVE EXAMPLE C 12

Post-treatment was first performed as described in Comparative Example C8 and then as described in Comparative Example C4. The oxide layer thus post-treated in two steps was assigned to grade 1.5 with respect to dyestuff adsorption and to grade b in respect of resistance to alkali.

EXAMPLE 3

The procedure employed was the same as described in Example 1, but with the exception that the aqueous solution additionally contained 0.1% of $Sr^{2+}$ ions [in the form of $Sr(NO_3)_2$]. The oxide layer thus post-treated in two steps was assigned to grade 0.5 with respect to dyestuff adsorption and to grade a with respect to resistance to alkali.

EXAMPLE 4

The procedure employed was the same as described in Example 1, with the exception that the aqueous solution additionally contained 0.1% of $Sr^{2+}$ ions [in the form of $Sr(OH)_2$] and 0.1% of levulinic acid in the first step. The oxide layer thus post-treated in two steps was assigned to grade 0.5 with in two steps was assigned to grade 0.5 with respect to dyestuff adsorption and to grade a with respect to resistance to alkali.

EXAMPLES 5 AND 6

The procedure employed was the same as described in Examples 3 and 4, with the exception that, in the roughening step, roughening was performed in an aqueous solution of HCl, as described in Comparative Example C2. Each of the oxide layers thus post-treated in two steps was assigned to grade 0.5 with respect to dyestuff adsorption and to grade a in respect to resistance to alkali.

EXAMPLE 7

Post-treatment was first performed as described in Comparative Example C3 and then as described in Comparative Example C9. The oxide layer thus post-treated in two steps was assigned to grade 1 with respect to dyestuff adsorption and to grade a with respect to resistance to alkali.

EXAMPLE 8

Post-treatment was first performed as described in Comparative Example C4 and then as described in Comparative Example C10. The oxide layer thus post-treated in two steps was assigned to grade 1.5 with respect to dyestuff adsorption and to grade b with respect to resistance to alkali.

We claim:

1. A process for manufacturing a roughened and anodically oxidized aluminum or aluminum alloy substrate, comprising the steps of:

(a) treating an aluminum oxide layer carried on a substrate comprised of aluminum or aluminum alloy in a first aqueous solution containing an alkali metal silicate; and then (b) treating said aluminum oxide layer (b) treating said aluminum oxide layer in a second aqueous solution containing at least one organic polymer comprised of at least one from the group consisting of vinylphosphonic acid monomers and vinylmethylphosphinic acid monomers.

2. A process as claimed in claim 1, wherein said first aqueous solution further contains alkaline earth metal ions.

3. A process as claimed in claim 2, wherein said alkaline earth metal ions are provided by water-soluble alkaline earth metal salts in said first aqueous solution.

4. A process as claimed in claim 3, wherein said alkaline earth metal salts comprise nitrates or hydroxides of calcium or strontium.

5. A process as claimed in claim 2, wherein said first aqueous solution further contains at least one substance which is capable of forming complexes with alkaline earth metal ions.

6. A process as claimed in claim 1, wherein said second aqueous solution contains polyvinylphosphonic acid.

7. A process as claimed in claim 1, wherein said first aqueous solution contains about 0.5 to 30% by weight of alkali metal silicate.

8. A process as claimed in claim 7, wherein said first aqueous solution further contains about 0.001 to 0.5% by weight of alkaline earth metal ions.

9. A process as claimed in claim 1, wherein said second aqueous solution contains about 0.01 to 10% by weight of said organic polymer.

10. A process as claimed in claim 1, wherein said steps (a) and (b) are separately performed electrochemically or by immersion, each of said steps (a) and (b) being performed over a period of about 0.5 to 120 seconds and at a temperature of about 15° to 80° C.

11. A process as claimed in claim 10, wherein at least one of said steps (a) and (b) is performed electrochemically at a current density of about 0.1 to 10 $A/dm^2$ and/or a voltage of about 1 to 100 V.

12. A process as claimed in claim 1, wherein said substrate is roughened, prior to being anodically oxidized, by a process comprising the step of electrochemically treating said substrate in an aqueous electrolyte solution comprising at least one from the group consisting of $HNO_3$ and HCl.

13. A process as claimed in claim 12, wherein said substrate, after being roughened, is anodically oxidized in an aqueous solution comprising at least one from the group consisting of $H_2SO_4$ and $H_3PO_4$.

14. A process as claimed in claim 1, wherein said steps (a) and (b) are performed separately by immersion.

15. A process as claimed in claim 14, wherein each of said steps (a) and (b) are performed over a period of about 0.5 to 120 seconds and at a temperature of about 15° to 80° C.

16. An offset printing plate comprising an aluminum or aluminum alloy substrate manufactured in accordance with the process claimed in claim 1.

* * * * *